United States Patent [19]

Shiibayashi

[11] Patent Number: 4,676,075

[45] Date of Patent: Jun. 30, 1987

[54] SCROLL-TYPE COMPRESSOR FOR HELIUM GAS

[75] Inventor: Masao Shiibayashi, Shimizu, Japan

[73] Assignee: Hitachi, Ltd., Tokyo, Japan

[21] Appl. No.: 826,672

[22] Filed: Feb. 6, 1986

[30] Foreign Application Priority Data

Feb. 15, 1985 [JP] Japan ..... 60-26255

[51] Int. Cl.[4] ..... F25B 43/02

[52] U.S. Cl. ..... 62/469; 62/503; 418/55

[58] Field of Search ..... 62/468, 469, 503, 505; 418/55; 417/366

[56] References Cited

U.S. PATENT DOCUMENTS

| | | | |
|---|---|---|---|
| 4,475,360 | 10/1984 | Suefuji et al. | 62/503 X |
| 4,564,339 | 1/1986 | Nakamura et al. | 418/55 X |
| 4,592,703 | 6/1986 | Inaba et al. | 418/55 X |
| 4,596,520 | 6/1986 | Arata et al. | 418/55 |

*Primary Examiner*—Lloyd L. King

*Attorney, Agent, or Firm*—Antonelli, Terry & Wands

[57] ABSTRACT

A scroll-type compressor for compressing helium gas includes stationary and orbiting scroll members each having an end plate and a spiral wrap, with the scroll members being assembled together to define compression spaces therebetween. A driven main shaft driven by has an eccentric mechanism engageable with the orbiting scroll member to cause an orbiting movement of the orbiting scroll member with respect to the stationary scroll member while preventing the orbiting scroll member to rotate about its own axis. The orbiting movement of the scroll member causes a radially inward movement of the compression spaces while progressively decreasing the volumes of the compression spaces, whereby the helium gas sucked through a suction port of the stationary scroll member is progressively compressed finally discharged from a discharge port. An oil injection system includes at least one oil injection port formed to open in the surface of the end plate of the stationary scroll member and injects an oil into the helium gas under compression in order to cool the same. The size of the oil injection port as measured in the direction of thickness of the scroll wrap is greater than the thickness of the scroll wrap of the orbiting scroll member.

10 Claims, 14 Drawing Figures

SCROLL-TYPE COMPRESSOR FOR HELIUM GAS

BACKGROUND OF THE INVENTION

The present invention relates to a scroll-type compressor for compressing helium gas, and, more particularly, to a scroll-type compressor having an oil injection mechanism for injecting a large amount of oil into compression chambers of the compressor for cooling the helium gas under compression, as well as the compressor itself.

A screw compressor of the aforementioned type is known as having an oil injection system wherein an oil of a high pressure and cooled by an oil cooler is injected into the compression chamber through an oil injection port, for cooling the compressor and the gas under compression.

In, for example, specification of the U.S. Pat. No. 4,475,360 a scroll-type compressor intended for use in an air conditioner is proposed, with the compressor having a gas injection system in which a gaseous refrigerant, extracted from an upper portion of a gas-liquid separator of a refrigeration cycle, is injected into spaces of the compression chamber in the compression phase, in order to enhance the cooling or heating power of the air conditioner.

In the case of scroll-type compressors, particularly those used for the compression of helium gas, it is desirable to inject a cooling oil into the compression chamber so as to cool the helium gas under compression and also the compressor, otherwise the compressor is excessively heated by the heat generated by the compressed helium gas.

The gas injection system described above, however, cannot be directly applied to the injection of oil in the scroll-type compressors for helium gas. Namely, in the above described gas injection system, the gas injection port through which the gaseous refrigerant is injected into the space of compression chamber has a diameter smaller than a thickness of a scroll wrap which slides on a scroll end plate in which the gas injection port is opened. Consequently, the gas injection port is intermittently blocked by the axial end surface of the scroll wrap, although the period of blockage of the oil is very short. This inconveniently causes a phenomenon similar to a so-called liquid hammeting action, resulting in a pressure pulsation of the oil confined in the oil injection port. The amplitude of the pressure pulsation becomes greater as the oil injection rate is increased, causing a tremendous vibration of the piping connected to the oil injection port, seriously affecting the reliability of the compressor as a whole.

On the other hand, a small sized oil injection port inevitably limits the possible rate of oil injection, failing to provide the required cooling effect under certain operating conditions of the compressor due to shortage of the cooling oil.

It is to be noted also that the injection port of the known injection system is positioned such as to open into the compression chamber only after the compression space thereof has been shut off from the suction port, so that the cooling oil cannot effectively cool the drawn gas which has been heated in the suction stage by the heat of the compressor, with a result that the performance of the compressor is undesireably impaired .

SUMMARY OF THE INVENTION

Accordingly, an object of the invention is to provide a scroll-type compressor for helium gas, having an oil injection system which is capable of suppressing the undesirable pressure pulsation of the oil in the oil injection system and, hence, the vibration of the piping of the oil injection system.

Another object of the invention is to provide a scroll-type compressor for helium gas, having an oil injection system which can supply the cooling oil at a sufficiently large supply rate, thus ensuring a good cooling effect on the compressed gas and the compressor.

For these purposes, according to the invention, a scroll-type compressor for helium gas is provided having a cooling oil injection system which includes at least one oil injection port formed to open in the surface of the stationary scroll member, with the size of the oil injection port, as measured in the direction of thickness of the scroll wrap of the orbiting scroll member being greater than the thickness of the scroll wrap thereof.

This arrangement eliminates the blockage of the oil injection port by the axial end surface of the scroll wrap of the orbiting scroll member, so that the oil injection line is always opened so as to remarkably suppress the pressure pulsation in the oil injection line, even when the cooling oil is supplied at a large rate. In other words, it is possible to maintain a sufficiently large rate of supply of the cooling oil, without the risk of the pressure pulsation.

According to a preferred form of the invention, the oil injection port is disposed at such a position where it can intermittently communicate with the suction chamber of the compressor, thereby effectively also cooling the gas which is still at low pressure, thus assuring a higher cooling effect to improve the volumetric efficiency of the compressor.

The above and other objects, features and advantages of the invention will become clear from the following description of the preferred embodiments when the same is read in conjunction with the accompanying drawings.

DETAILED DESCRIPTION

Figure 1:
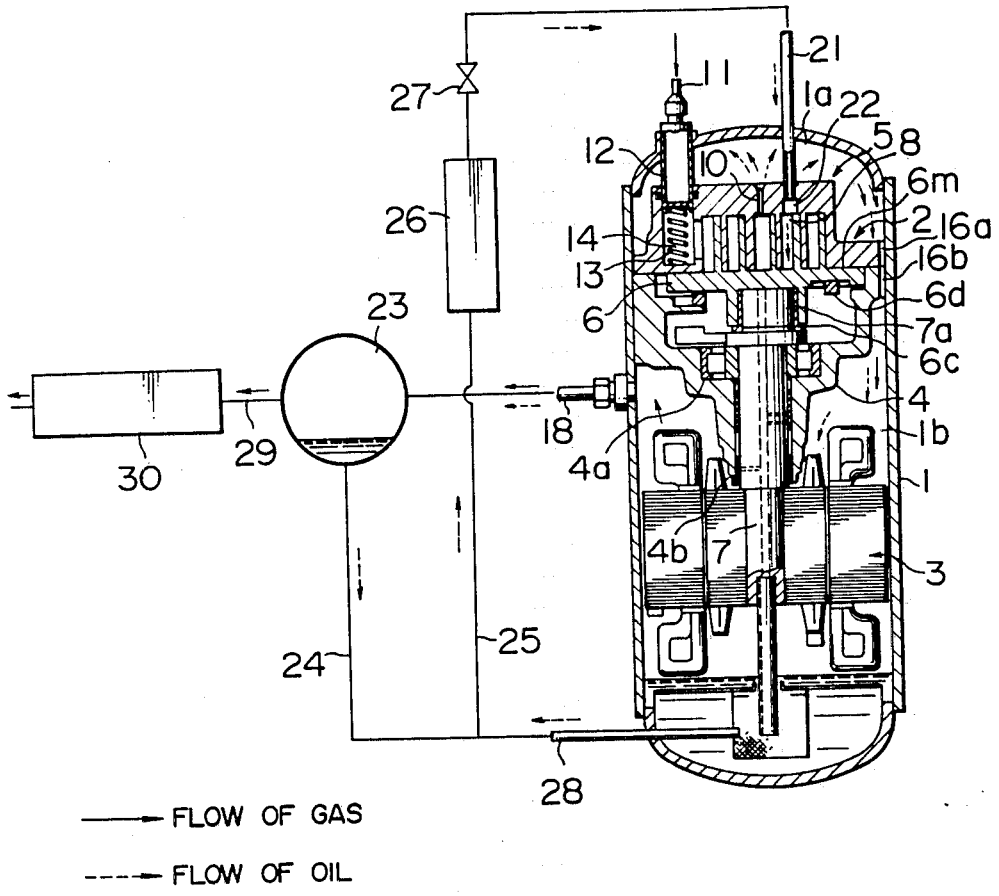
FIG. 1 is a partially schematic sectional view of a scroll-type compressor constructed in accordance with the present invention for compressing helium gas and equipped with an oil injection system.

Referring now to the drawings wherein like reference numerals are used throughout the various views to designate like parts and, more particularly, to FIG. 1, according to this figure, a scroll-type compressor unit for compressing helium gas equipped with an oil injection system is provided with the compressor unit including a hermetic container 1 for accommodating a vertical type motor-compressor assembly comprising an upper scroll compressor section 2 and a lower electric motor section 3. The upper scroll compressor section includes a stationary scroll member 5 and an orbiting scroll member 6 forming compression elements, a mechanism 6*d* for preventing the orbiting scroll member 6 from rotating about its own axis, a main shaft 7 having a crankshaft 7*a* for engaging with the orbiting scroll member 6, and bearings for supporting the main shaft 7, namely, a bearing 6*c* provided on the orbiting scroll member 6, a main bearing 4*a* formed on the frame 4, and an auxiliary bearing 4*b* provided under the main bearing 4*a* . The hermetic compressor unit is of high-pressure chamber type, in which the space inside the hermetic container 1 is maintained at the same level as the high-pressure side of the compressor, i.e., the same level as the discharge pressure of the compressor. The stationary and orbiting scroll members 5 and 6 have scroll wraps formed along involute or similar curves and mesh with each other.

The operation of this scroll-type compressor will be explained in accordance with the flow of the helium gas, while omitting the explanation of the flow of the lubricating oil in the compressor.

The helium gas of low temperature and pressure is introduced into the confined spaces of the compression chamber defined by the compression elements, through a suction pipe 11, suction coupling 12, check valve 13 and through a suction port 14 formed in the stationary scroll member 5 as indicated by solid-line arrows in FIG. 1. The orbiting scroll member 6 is driven to perform an orbiting motion, while being prevented from rotating about its own axis, so that the closed spaces 8 between the scroll members are gradually moved towards the center of the scroll, while progressively decreasing their volumes. Consequently, the helium gas, confined in each space 8, is gradually compressed and, when this space 8 is brought into communication with a discharge port 10 formed in the central portion of the stationary scroll member, discharged through the discharge port 10. The discharged helium gas of high temperature and pressure is introduced into an upper space 1*a* formed in the hermetic container 1 and, after filling a space 1*b* around the electric motor past passages 16*a*, 16*b*, discharged to the outside of the compressor through a discharge pipe 18 at a discharge pressure Pd. An oil injection pipe 21 is connected to an oil injection port 22 formed in the end plate of the stationary scroll member 5.

In the steady operation of the compressor, the oil supplied from the oil, injection pipe 21, is injected into the compression spaces 8 through the oil injection port 22, thereby cooling the gas under compression within the spaces 8. The oil injected into the compression spaces 8 is mixed with the gas and is discharged through the discharge port 10 into the discharge space 1*a* together with the compressed gas. The oil is then introduced through the passages 16*a* and 16*b* into the space 1*b* around the electric motor, where the oil is separated from the gas. The separated oil drops into an oil pan formed in the bottom of the hermetic container 1. It will be seen that, in the high-pressure chamber type compressor described, the hermetic container 1 itself has an oil separating function. The gas, with reduced oil content, is then delivered to an external oil separator 23 through the discharge pipe 18, where the oil still remaining in the gas is separated. The oil separated in the oil separator 23 is introduced into the oil injection pipe 21 through oil pipes 24, 25, an oil cooler 26 and an oil flow-rate control valve 27, so as to be used as the cooling oil to be injected. An oil draining pipe 28, connected to the bottom of the hermetic container, merges in the oil pipes 24, 25. Thus, the oil draining pipe 28 and oil pipes 21, 24 and 25 constitute an oil injection pipe line system. In FIG. 1, the solid-line arrows indicate the flow of the helium gas, while each broken-line arrow indicates the direction of flow of the oil. The gas separated from the oil in the oil separator 23 is forwarded to an external line through a gas cooler 30.

A detailed description will be made hereinunder as to the oil injection port 22 which constitutes an essential feature of the invention.

Figure 2:
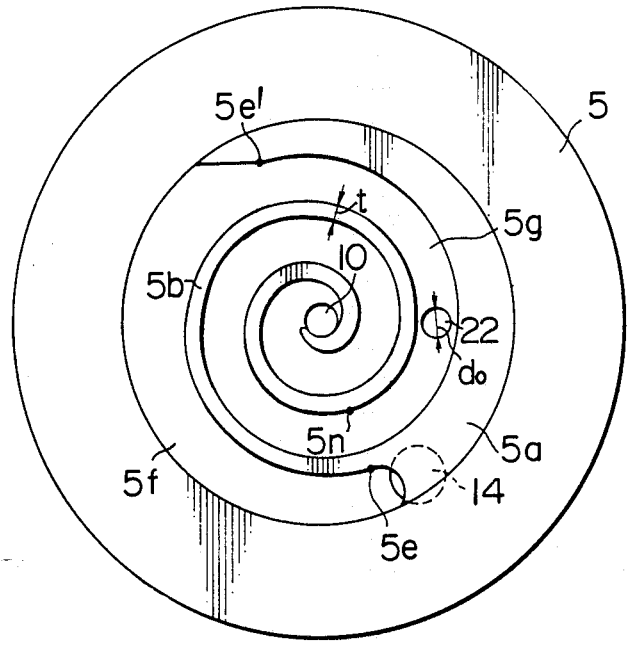
FIG. 2 is a bottom plan view of a stationary scroll member incorporated in the scroll-type compressor shown in FIG. 1.

In FIG. 2, numerals 5*e* and 5*e'* denote the wrapping ends of the scroll wrap 5*b* of the stationary scroll member 5 and it will be seen that the oil injection port 22*a* is formed substantially at a middle portion of the surface 5*g* of the end plate 5*a* between adjacent turns of the scroll wrap of the stationary scroll member 5.

Figure 3A:
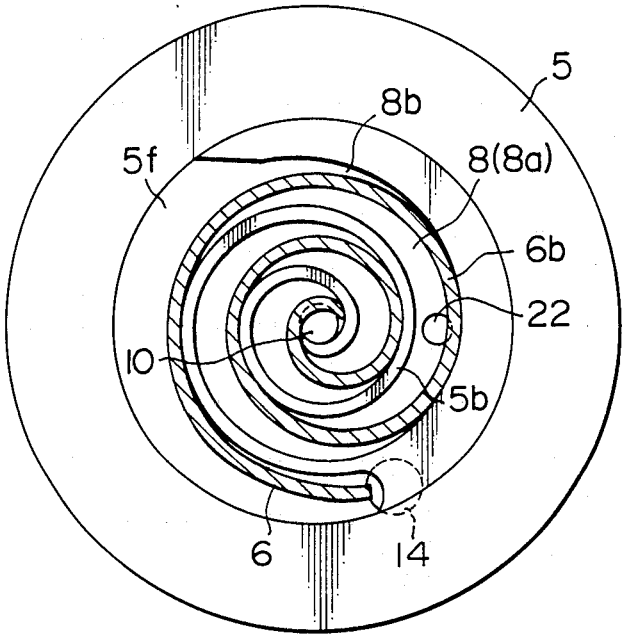
FIGS. 3(*a*) and 3(*b*) are partial cross-sectional plan views of the scroll-type compressor shown in FIG. 1, illustrating the states of engagement between the scroll wraps of the stationary scroll member and an orbiting scroll member in different orbiting positions of the orbiting scroll member.

As shown in FIG. 3*a*, the oil injection port 22 opens to a closed compression space 8*a* which is in a compression phase. In the state shown in FIG. 3*b*, however, the oil injection port 22 is communicated also with a suction chamber 5*f* through another space 8*b*. The space 8*b* constitutes a suction space which communicates with the suction chamber 5*f* or the closed compression space, depending on the orbiting position of the orbiting scroll member 6. Thus, the injection port 22 is located at a position where the port 22 intermittently communicates through the space 8*b* with the suction chamber 5*f* which is defined on the outer periphery of both scroll wraps.

The position where the injection port 22 opens, i.e., the position of the center of the port 22, is determined, for example, to be about 100° from the position immediately after the completion of the suction phase, so that the injection port can intermittently communicate with the suction chamber. In other words, the oil injection port 22 is located at a position which is about 0.7 turn in terms of the angle wrap as measured inwardly from the outer end 5e of the scroll wrap of the stationary scroll member.

Since the position of the oil injection port 22 is selected such that this port 22 intermittently communicates with the suction chamber, the gas which is being drawn and heated by the compressor can be effectively cooled by the cooling oil injected through the oil injection port 22, whereby the volumetric efficiency of the compressor can be remarkably improved.

According to the invention, in order to allow the cooling oil injection at a sufficiently large rate, and to suppress the pulsation of the pressure in the oil injection piping line system, the opening of the oil injection port 22 in the surface 5g of the end plate 5a of the stationary scroll member 5 has a diameter $d_0$ which is greater than a thickness t of the scroll wrap.

Namely, the following condition is met:

$$d_0 > t$$

where, t represents the thickness (mm) of the scroll wrap, while $d_0$ represents the diameter (mm) of the oil injection port 22.

Figure 4:
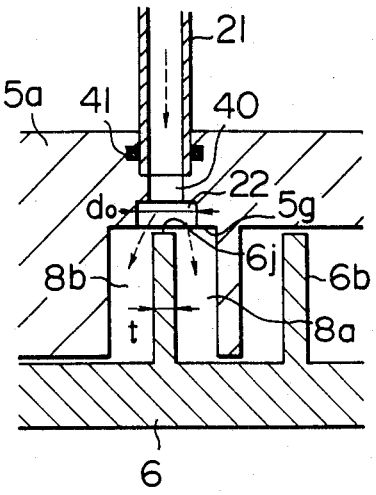
FIG. 4 is a sectional view of a portion of the stationary scroll member where an oil injection port is formed.

As shown in FIG. 4, the oil injection port 22 is connected to the oil injection pipe 21 through a bore 40. An an "O" ring 41 fits around the oil injection pipe 21 so as to provide a pressure-tight seal. The diameter of the bore 40 may be smaller than that of the oil injection port 22, provided that it can provide the greatest rate of the cooling oil injection demanded by the compressor.

According to the invention, since the oil injection port 22 opening in the end plate 5a of the stationary scroll member has a diameter $d_0$ which is greater than the thickness of the scroll wrap 6b, the undesirable blocking of the oil injection port by an axial end surface 6j of the scroll wrap is avoided and continuous injection of the cooling oil is ensured.

It is to be understood also that, according to the invention, the cooling oil can be injected alternatingly into both the two spaces 8a and 8b defined by both scroll wraps, through the single oil injection port 22 which is located substantially at the middle portion of the surface 5g between the adjacent turns of the scroll wrap of the stationary scroll member. This, however, is not exclusive and no substantial problem is caused even if the oil injection port 22 may be radially offset from the above-mentioned middle portion.

An explanation will be made hereinunder as to the position of the oil injection port, with specific reference to FIG. 5, a solid-line curve shows the changes in the pressure observed when the oil injection port is located at a position which is $\lambda_{02}$ in terms of the scroll wrap angle. A numeral ② designates the point at which the compression is commenced. A broken-line curve shows the changes in the pressure observed when the oil injection port is located at a position which is $\lambda_{01}$ ($\lambda_{01} \leqq \lambda_{02}$) in terms of the wrap angle. On the other hand, a one-dot-and-dash line curve shows the changes in the pressure as observed when the compression is performed in an ideal adiabatic condition. It will be seen that the pressure in the compression chamber comes down below the ideal adiabatic curve shown by the one-dot-and-dash line as the compression of the gas is being progressed, as a result of the cooling of the compressed helium gas by the oil injected into the compression chamber.

Figure 5:
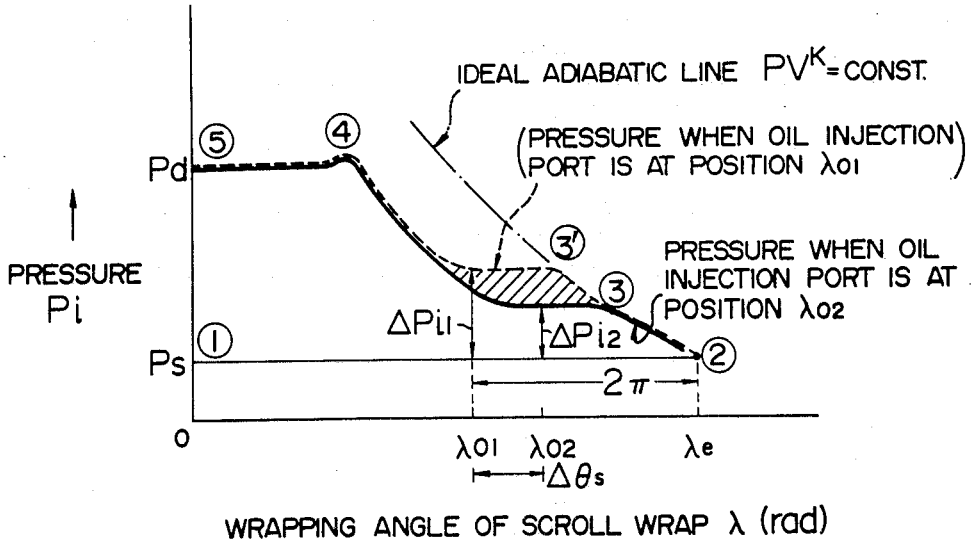
FIG. 5 is a graphical illustration of a change in the pressure of a compression chamber with respect to the position of an oil injection port.

The symbols $\lambda_e$, $\lambda_{01}$ and $\lambda_{02}$ appearing in FIG. 5 represent respective wrap angles which are defined as follows:

$\lambda_e$: the angle (rad) of the wrap terminating end of the scroll wrap (the wrap angle at the positions 5e, 5e' in FIG. 2), $\lambda_{01}$: the wrap angle (rad) at the position immediately after the completion of the suction (the wrap angle at the position 5n in FIG. 2), $\lambda_{02}$: the wrap angle (rad) at the position of the center of the oil injection port 22 in FIG. 2.

When the oil injection port is located at the position which is $\lambda_{02}$ in terms of the wrap angle, the effect of cooling on the helium gas is enhanced to permit a reduction in the power required for driving the compressor, by an amount corresponding to the difference between the area defined by points ①, ②, ③, ④, ⑤ and the area defined by the points ①, ②, ③ , ④, ⑤ in FIG. 5. Thus, the power required for driving the compressor is changed by the amount corresponding to the hatched area in FIG. 5, depending on the position of the oil injection port. In FIG. 5, symbols $\Delta P_{i1}$ and $\Delta P_{i2}$ represent the amounts of changes in the pressure as observed when the oil injection port is located at the positions of $\lambda_{01}$ and $\lambda_{02}$ in terms of the wrap angle, respectively. It will be seen that the pressure change $\Delta P_{i1}$ is greater than the pressure change $\Delta P_{i2}$. The changes in the pressure are transmitted to the injection pipe 21 and further to the oil injection pipe line system, so as to cause a vibration of the piping system. It will thus be seen that the vibration of the oil injection pipe line system is suppressed when the oil injection port is located at the position of $\lambda_{02}$ as compared with the case where the oil injection port is located at the position of $\lambda_{01}$.

Preferably, the position $\lambda_{02}$ of the oil injection port is about 0.7 turn of the scroll wrap as measured inwardly from the wrap terminating ends 5e, 5e', for the reasons which will be explained hereinbelow.

The revolution angle $\Delta\theta_s$ through which the oil injection port is held in communication with the suction chamber 5f is given by $\Delta\theta_s = \lambda_{02} - \lambda_{01}$. Conventionally, it has been a common understanding in the field of volume-type compressors that from the view point of the performance of a compressor, it is preferable to locate an oil injection port 22 at such a position that the port is never communicated with the suction side of the compressor; however, it has been found that, insofar as a scroll-type compressor is concerned, the position of the oil injection port 22 can be shifted towards the low-pressure side to the position $\lambda_{02}$ by an angle corresponding to the thickness t of the scroll wrap, without causing any inconvenience. This angle $\Delta\theta_s^*$ is given by the following formula:

$$\Delta\theta_s^* = t/a$$

where, t represents the thickness (mm) of the scroll wrap, while a represents the radius (mm) of the basic circle of the scroll wrap.

Figure 3B:
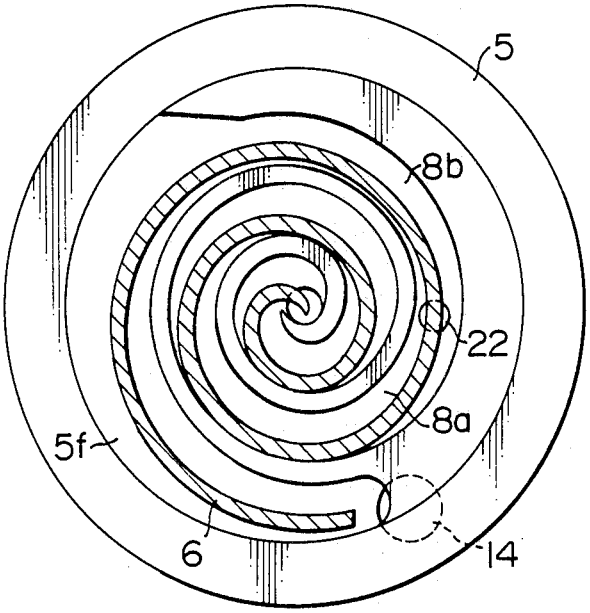

In the embodiment of FIGS. 2 and 3a, 3b, the oil injection port is located to meet the condition of $\Delta\theta_s \approx \Delta\theta_s^*$. Namely, no substantial reduction in the performance of the compressor, i.e., volumetric efficiency $\eta_v$, is caused even though the position of the oil injection port is shifted towards the low-pressure side by an angle represented by $\Delta\theta_s^*$. Thus, such a shift of the position of the oil injection port 22 does not cause any practical problem if the amount of shift of the position of oil injection port 22 falls within the angular range expressed by $\Delta\theta_s$*, partly because most of the area of the oil injection port 22 is closed by the axial end surface of the scroll wrap, although only a small part of the area of the oil injection port 22 is allowed to intermittently communicate with the suction side, and partly because the small area opening to the suction side is materially closed by the injection oil itself which in this case serves as a sealant.

An explanation will be made hereinunder as to the influence of the diameter $d_0$ of the oil injection port 22 on the performance of the compressor as a whole, with specific reference to FIG. 6.

Figure 6:
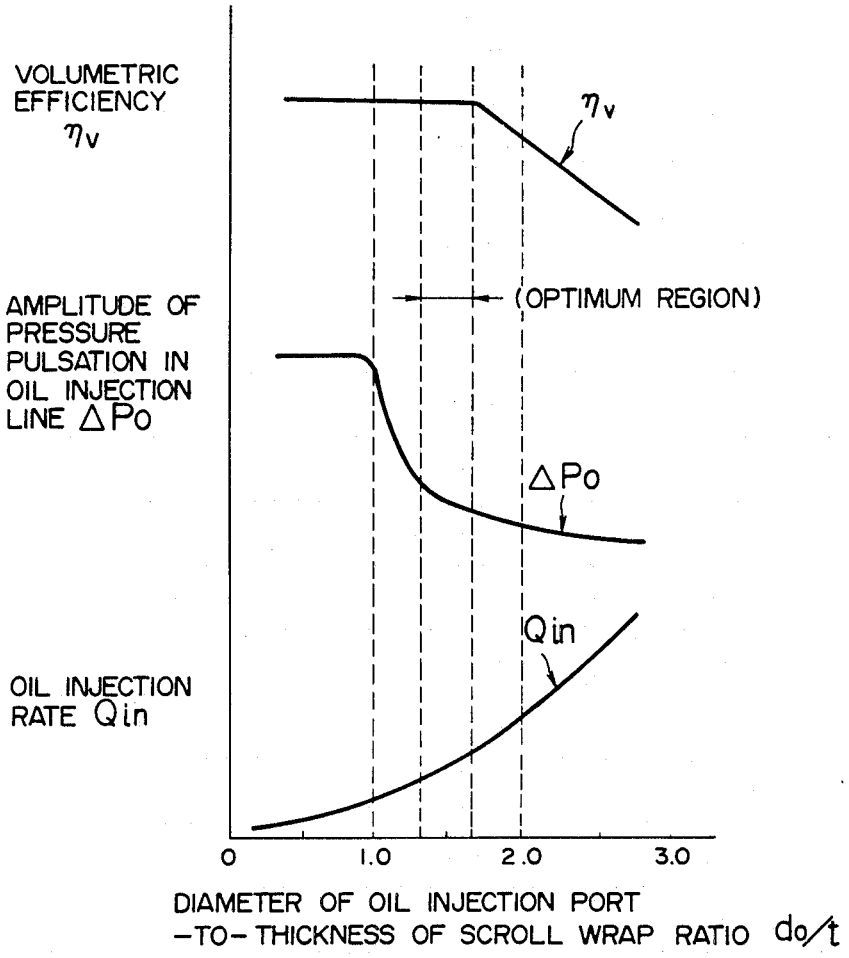
FIG. 6 is a relationship between a size of the oil injection port and a performance of the compressor.

In FIG. 6, the abscissa represents the diameter-to-thickness ratio $d_0/t$ between the diameter $d_0$ of the oil injection port and the thickness t of the scroll wrap. When the ratio $d_0/t$ takes a value exceeding 2.0, the period of communication between the oil injection port 22 and the suction side is prolonged and the effect of sealing of the injection port 22 by the axial end surface of the scroll wrap is impaired, with a result that the suction rate of the gas is reduced as the rate of injection of the oil is increased, causing a reduction in the volumetric efficiency $\eta_v$ of the compressor.

On the other hand, a value of the ratio $d_0/t$ below 1.0 causes problems such as large pressure pulsation in the oil injection pipe line system and too small oil injection rate Qin. The oil injection rate Qin in this case represents the amount of oil injected per unit pressure differential across the oil injection port 22. For these reasons, the oil injection port 22 is so sized that the ratio $d_0/t$ ranges between 1.0 and 2.0 and, more preferably, around 1.5 from the view points of performance of the compressor, cooling effect and the reliability. An experiment showed that the best result is obtained when the ratio $d_0/t$ ranges between 1.3 and 1.7.

In FIGS. 7(*a*) and 7(*b*) two oil injection ports 45*a* and 45*b* are formed in the end plate 5*a* of the stationary scroll member 5 along the side surface of the scroll wrap 5*b* of the scroll member 5.

In the state shown in FIG. 7(*a*), both the oil injection ports 45*a* and 45*b* open to closed compression spaces 8*b*', 8*a*', respectively. In the state shown in FIG. 7(*b*), however, the orbiting scroll member has been moved along its orbit to a position where one of the oil injection ports 45*b* opens also to a space 8*f* so as to be communicated with the suction chamber 5*f* through the space 8*f*.

Figure 8:
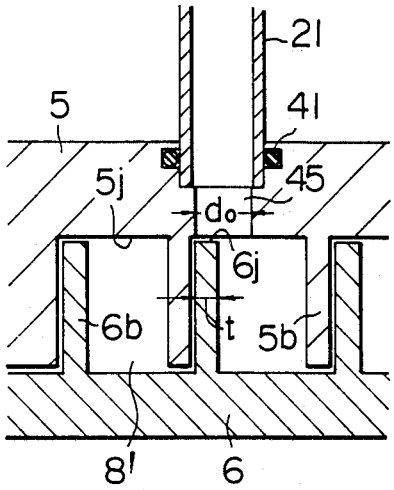
FIG. 8 is a sectional view of an end plate of the stationary scroll member of the compressor shown in FIGS. 7(*a*) and 7(*b*) illustrating a portion of the end plate where an oil injection port is formed.

FIG. 8 shows the detail of the oil injection port of this embodiment, in which only one of the oil injection ports 45*a* and 45*b* is shown and represented by numeral 45.

In FIG. 8, the diameter $d_0$ of the oil injection port 45 communicated with the compression chamber 8' is greater than the thickness t of the scroll wrap, in order to suppress the pulsation of pressure in the oil injection pipe 21' which otherwise would be caused by the blockage of the port 45 by the axial end surface 6*j* of the scroll wrap and to ensure a sufficiently large rate of the cooling oil injection. In this embodiment, the oil injection ports 45 are located at positions 5*n*, 5*n*' which correspond to one turn of the scroll wrap as measured form the wrap terminating ends 5*e*, 5*e*'. Thus, the position of the oil injection ports is shifted radially inwardly from the position of the oil injection port in the preceding embodiment. Such a shift, however, does not cause any problem because the intermittent communication between the oil injection ports and the suction chamber 5*f* is ensured by virtue of the large diameters of the oil injection ports 45, thus preserving an appreciable effect of cooling of the gas which is being sucked into the compressor before compression.

Figure 9:
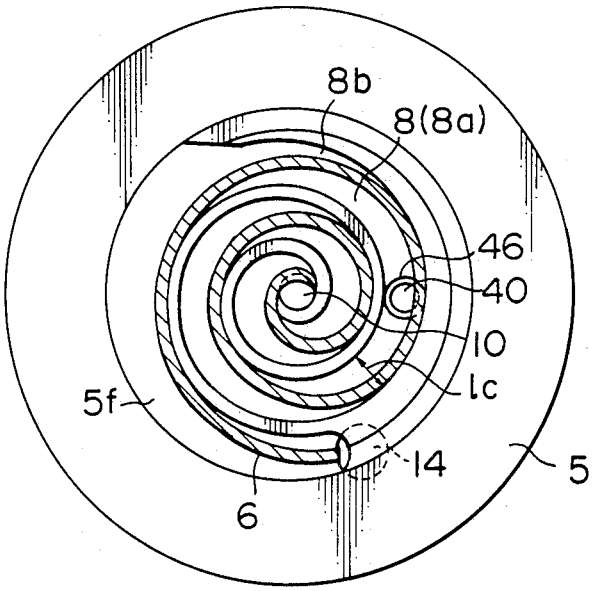
FIG. 9 is a partial cross-sectional view of another embodiment of the scroll-type compressor, illustrating states of engagement between the scroll wraps of both scroll members in different orbiting positions of the orbiting scroll member.
Figure 10:
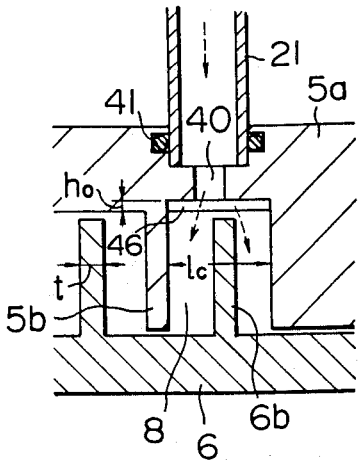
FIG. 10 is a sectional view of an end plate of the stationary scroll member of the compressor of FIG. 9, illustrating a detail of a portion of the end plate where an oil injection port is formed.

In FIG. 9, an oil injection port 46 is disposed at the same position as that in the embodiment shown in FIGS. 2 and 3*a*, 3*b*. As will be seen from FIG. 10 showing the detail of the construction of the oil injection port 46, however, the oil injection port 46 is formed by recessing the surface of the end plate 5*a* to a predetermined depth $h_0$ so as to communicate with the oil injection bore 40, the oil injection port 46 in the form of the recess having a diameter $d_0$ which equals to the pitch $l_c$ of the scroll wrap. The oil injection bore 40 provides a communication between the oil injection port 46 and the oil injection pipe 21. The diameter of the oil injection bore 40 may be small, provided that the maximum oil injection rate demanded by the compressor is assured.

Thus, in the embodiment shown in FIGS. 9 and 10, the diameter $d_0$ of the oil injection port 46 is determined to meet the following condition:

$$d_0 = l_c$$

where, $l_c$ represents the pitch (mm) of the scroll wrap 5*b*, while $d_0$ represents the diameter (mm) of the oil injection port 46.

The embodiments described hereinbefore have a function for avoiding the risk of liquid oil compression. Namely, in the embodiments shown in FIGS. 2, 3*a*, 3*b* and in FIG. 9, respectively, the oil is injected not into the completely closed compression space but into the space which intermittently communicates with the suction chamber. More specifically, the position of the oil injection port 22 or 46 is so selected so that it can communicate with the suction chamber 5*f* over a predetermined angular range which is shown by $\Delta\theta_s$ in FIG. 5, amounting to about 100° in the embodiment shown in FIGS. 2 and 3a, 3*b*. Since the suction chamber 5*f* always opens to the low-pressure and the suction side, the risk of the liquid oil compression is avoided.

Figure 7A:
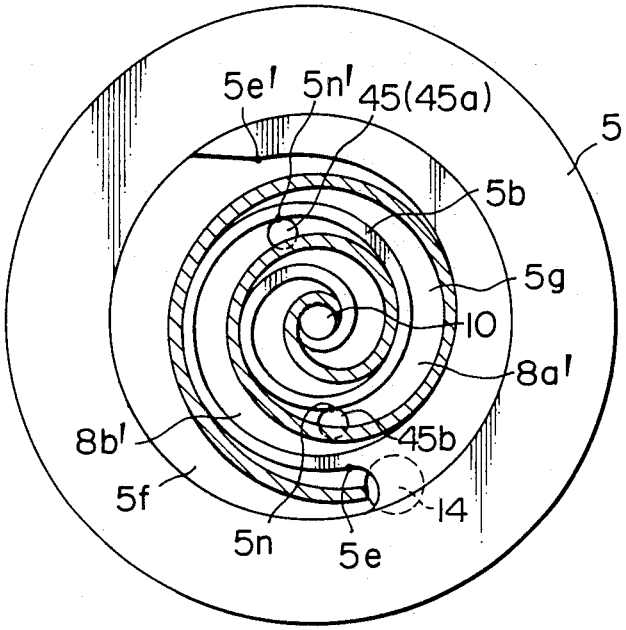
FIGS. 7(*a*) and 7(*b*) are partial cross-sectional views of another embodiment of the scroll-type compressor of the invention, illustrating states of engagement between the scroll wraps of both scroll members in different orbiting positions of the orbiting scroll member.
Figure 7B:
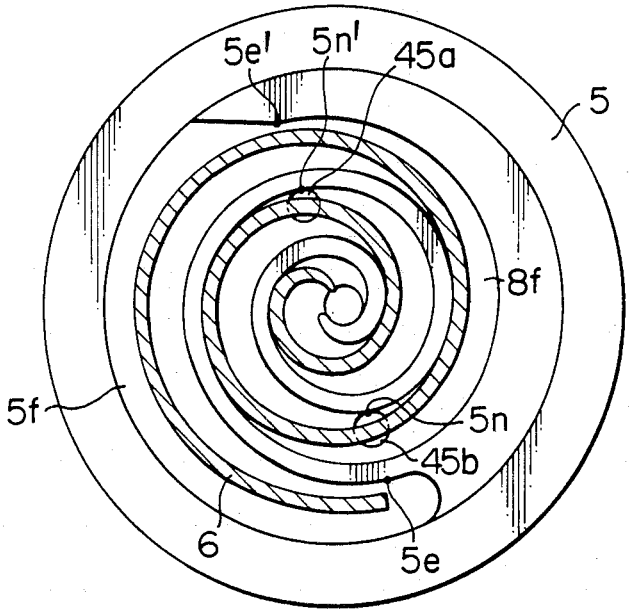

On the other hand, in the embodiment shown in FIGS. 7*a*, 7*b*, adjacent compression spaces 8'*a* and 8'*b* are communicated with each other through the oil injection ports 45*a*, 45*b* which are connected together to the oil injection pipe, so that the oil injection system as a whole is not blocked, whereby the risk of the liquid oil compression is avoided.

Figure 11:
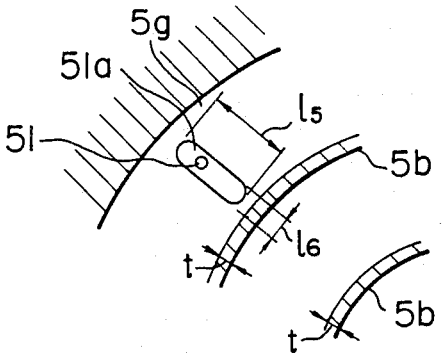
FIG. 11 is a plan view of a further embodiment, illustrating a portion of the stationary scroll member around an oil injection port.
Figure 12:
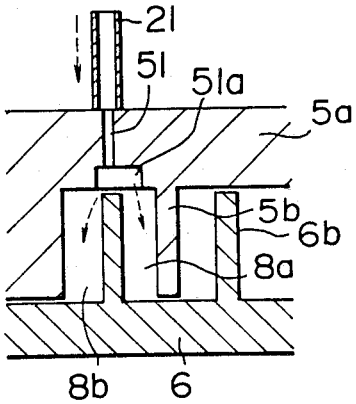
FIG. 12 is a sectional view of the portion of the end plate shown in FIG. 11 around the oil injection port.

As shown in FIG. 11, an oil injection port 51 has an elongated bore portion 51*a*. Athough the width $l_6$ of the elongated bore portion 51*a* is smaller than the thickness t of the scroll wrap, the length $l_5$ of the bore portion 51*a* is greater than the wrap thickness t, so that the oil injection port 51 can inject the cooling oil alternatingly into both compression spaces 8*a*, 8*b*. In addition, the opening area of the oil injection port 51 is large enough to ensure the oil injection at the maximum rate demanded by the compressor.

Thus, the oil injection port can have any desired form, though circular forms are preferred from the view point of easiness of the machining.

Having described the invention through its preferred forms, it is to be noted that the described embodiments are only illustrative and various changes and modifications may be imparted thereto without departing from the scope of the invention which is limited solely by the appended claims.

What is claimed is:

1. A scroll-type compressor for helium gas, said compressor having stationary and orbiting scroll members each having a discoidal end plate and a spiral wrap protruding upright from said end plate, said scroll members being assembled together with said scroll wraps meshing with each other, a main shaft having an eccentric mechanism engaging with said orbiting scroll member so as to cause an orbiting movement of said orbiting scroll member with respect to said stationary scroll member while preventing said orbiting scroll member from rotating about its own axis, a suction port and a discharge port formed in a central portion and an outer peripheral portion of said end plate of said stationary scroll member, respectively, so that the orbiting movement of said scroll member causes a radially inward movement of closed compression spaces defined between said scroll members while progressively decreasing volumes of said compression spaces, whereby the helium gas sucked through said suction port is progressively compressed in said compression spaces and finally discharged from said discharge port, and an oil injection system including at least one oil injection port formed to open in a surface of said end plate of said stationary scroll member and adapted for injecting an oil into the helium gas under compression in order to cool the helium gas, wherein the improvement comprises that a size of said oil injection port as measured in a direction of thickness of said scroll wrap is greater than the thickness of said scroll wrap, and said oil injection port opens opposite to an end portion of the wrap of the orbiting scroll member.

2. A scroll-type compressor according to claim 1, wherein said oil injection system has only one oil injection port which is located at a position where the port intermittently communicates with a suction chamber which is defined on an outer periphery of said scroll wraps.

3. A scroll-type compressor according to claim 1, wherein said oil injection port is located at a position which is 0.7 turn in terms of the wrap of said scroll member as measured inwardly from wrap terminating ends of said scroll wrap of said stationary scroll member.

4. A scroll-type compressor according to claim 1, wherein said oil injection port has a circular form of a diameter which is 1 to 2 times as large as a thickness of said scroll wrap.

5. A scroll-type compressor according to claim 3, wherein said oil injection port has a diameter which is 1.3 to 1.7 times as large as the thickness of said scroll wrap.

6. A scroll-type compressor according to claim 1, wherein said oil injection port has a form which is elongated in a direction of thickness of said scroll wrap.

7. A scroll-type compressor according to claim 1, wherein an opening of said oil injection port has a diameter which is substantially equal to a pitch of said scroll wrap.

8. A scroll-type compressor according to claim 1, wherein said oil injection port is positioned and sized so as to simultaneously communicate with adjacent compression spaces on both sides of said scroll wrap of said orbiting scroll member.

9. A scroll-type compressor according to claim 1, wherein said oil injection port is positioned and sized so as to alternatingly communicate with adjacent compression spaces on both sides of said scroll wrap of said orbiting scroll member.

10. A scroll-type compressor for helium gas comprising: a hermetic container for accommodating a motor-compressor unit constituted by an upper scroll compressor section and a lower electric motor section which are connected to each other through a main shaft rotatably supported by a frame; said scroll compressor section including stationary and orbiting scroll members each having an discoidal end plate and a spiral wrap protruding upright from said end plate, said scroll members being assembled together with said scroll wraps meshing with each other, said main shaft having an eccentric mechanism engaging with said orbiting scroll member so as to cause an orbiting movement of said orbiting scroll member with respect to said stationary scroll member while preventing said orbiting scroll member from rotating about its own axis, a suction port and a discharge port formed in a central portion and an outer peripheral portion of said end plate of said stationary scroll member, respectively, so that the orbiting movement of said scroll member causes a radially inward movement of closed compression spaces defined between said scroll members while progressively decreasing the volume of said compression chamber, whereby the helium gas sucked through said suction port is progressively compressed in said compression spaces and finally discharged from said discharge port into a space in said hermetic container so as to maintain a high discharge pressure in said space of said hermetic container, the compressed gas then being delivered to an outside of said compressor through a discharge pipe; an oil separator connected to said discharge pipe for separating an oil from said compressed gas; an oil cooler for cooling the oil separated in said oil separator and the oil stored in an bottom portion of said hermetic container; and an oil injection system including at least one oil injection port formed to open in a surface of said end plate of said stationary scroll member for injecting the oil cooled by said oil cooler into the helium gas under compression to cool said helium gas, and a oil injection pipe line connecting said oil cooler with said oil injection port for delivery of the cooled oil, and wherein a size of said oil injection port as measured in a direction of thickness of said scroll wrap is greater than the thickness of said scroll wrap of said orbiting scroll member.

* * * * *